US005309633A

United States Patent [19]

Ricard

[11] Patent Number: 5,309,633

[45] Date of Patent: May 10, 1994

[54] METHOD AND DEVICE FOR FORMING WIRING HARNESSES

[76] Inventor: Claude Ricard, Villa Ste. Magdeleine, 52 cours Gambetta, 13100 Aix En Provence, France

[21] Appl. No.: 971,155

[22] Filed: Nov. 4, 1992

Related U.S. Application Data

[63] Continuation-in-part of Ser. No. 806,195, Dec. 13, 1991, abandoned.

[30] Foreign Application Priority Data

Dec. 13, 1990 [FR] France ..... 90 15969
Dec. 13, 1990 [FR] France ..... 90 15970

[51] Int. Cl.[5] ..... H01R 43/04

[52] U.S. Cl. ..... 29/861; 29/33 M; 29/564.1; 29/749

[58] Field of Search ..... 29/861, 749, 564.1, 29/33 M

[56] References Cited

U.S. PATENT DOCUMENTS 4,428,114 1/1984 Teagno ..... 29/748 X
4,581,796 4/1986 Fukuda et al. ..... 29/748 X
4,835,858 6/1989 Adlon et al. ..... 29/748 X
5,083,369 1/1992 Cerda ..... 29/857
5,205,329 4/1993 Suzuki et al. ..... 29/755 X
5,208,977 5/1993 Ricard ..... 29/33 MX

FOREIGN PATENT DOCUMENTS 2555397 5/1985 France .
2619258 2/1989 France .

*Primary Examiner*—Carl J. Arbes
*Attorney, Agent, or Firm*—Browdy and Neimark

[57] ABSTRACT

The present invention relates to a method and device for forming a wiring harness comprising a plurality of conductors with their ends either engaged to a conductor or remaining bare for later connection. The method and device results in each connector or group of bare ends of the wiring harness having a predetermined geographic position corresponding to a desired coupling position to enable the connector or group of bare ends to be engaged to equipment to be interconnected by the wiring harness. Each conductor of the final wiring harness follows a predetermined path inside the harness between its ends, such paths having common portions along which the conductors are bound together. The invention applies more particularly, although not exclusively, to the formation of wiring harnesses for connecting together numerous pieces of electric, electronic or other equipment required in automobiles, aircraft or other systems.

15 Claims, 9 Drawing Sheets y
y'
x
x'
2A
2'A
2"A
2B
2'B
2"B
2C
2'C
2"C
2D
2'D
2"D
2E
2"E
A
B
C
D
E
13
12
8
9
11
10
7j
4z
3c
4y
7a
4x
7d
3'd
3a
7h
7g
7f
4
15A
15B
15C
15D
15E
3b
3c
3a
3'd
3'e
3'f
25
3g
24
7i
3l
4'd
4d
7b
4a
4'a
7c
4'b
4b
7e
3'e
4'c
4c
3g
3'h y
y'
z
z'
I
II
13
12
9
8
10b
10
10a
11
14
3b
3c
3a
3'd
3'e
3'f
3g
24

METHOD AND DEVICE FOR FORMING WIRING HARNESSES

This is a CIP of patent, copending application Ser. No. 07/806,195, Dec. 13, 1991, now abandoned, the contents of which are incorporated herein by reference.

BACKGROUND OF THE INVENTION

1. Field of the Invention

The present invention relates to a method and device for forming a wiring harness comprising a plurality of conductors with their ends either engaged to a connector or remaining bare for later connection. The inventive method and device results in each connector or group of bare ends of the wiring harness having a predetermined geographic position corresponding to a desired coupling position to enable the connector or group of bare ends to be engaged to equipment to be interconnected by the wiring harness. Each conductor of the final wiring harness follows a predetermined path inside the harness between its ends, such paths having common portions along which the conductors are bound together. The invention applies more particularly, although not exclusively, to the formation of wiring harnesses for connecting together numerous pieces of electric, electronic or other equipment required in automobiles, aircraft or other systems.

Conventionally, such wiring harnesses are made by representing the paths of the different conductors forming the wiring harness graphically on a sheet of paper disposed on a table, under a transparent plate formed with a plurality of holes for receiving guiding pins for maintaining the conductors temporarily in position along their path.

For each conductor to be positioned, the assembler must first of all identify it, then, by means of technical documentation, search among the plurality of paths for the one which corresponds to the conductor he has just identified. The assembler may then position the conductor following the plot of its path, and holding it there by means of guide pins disposed, by the assembler, in appropriate positions along the path. The assembler must of course begin this set of operations again for each conductor of the harness.

Such work is obviously fastidious and errors are practically inevitable, considering both the length of the tables and the fact that the formation of such harnesses may use several hundred conductors. Even though a "skeleton" of the harness is represented on the table, the assembler finds himself in fact in front of a veritable "jumble" of interlaced conductors which are difficult to control.

The object of the present invention is to overcome these drawbacks, and provide a method and device for automatically forming such wiring harnesses.

2. Prior Art

French Patent application FR 90 13137 by Claude Ricard filed on Oct. 17, 1990 describes processes and devices that begin the automatic making of cable bundles or wiring harness by first gathering multiple ends of selected wire sections of the bundle and engage them either in an end clamp for transfer by a supply conveyor or in a connector which is then engaged in a component clamp for transfer by the same supply conveyor. This invention intends that both the end clamps and the component clamps be respectively disengaged from the multiple ends engaged by the end clamps and the connectors engaged by the component clamps when the harness is ready to interconnect the equipment intended to form a desired system.

French Patent FR 2,619,258 (Claude Ricard) filed Aug. 7, 1987, and U.S. Pat. No. 4,715,099 (YOSHIDA) of Dec. 29, 1987 described wiring machines wherein several conductor wires are transported by clamps which are placed on a supply conveyor associated with the machine, said clamps each holding one end of a wire section. The Ricard patent also describes the making of the supply conveyor and the clamps.

These machines are controlled by a programmable central computer. They automatically cut sections of wires whose length is determined by the program. Said machines strip the section ends and automatically perform crimping operations.

French Patent FR-A-2,555,397 describes another type of automatic machine and a connection device for simple bundles shown in FIGS. 7 to 11 of the patent.

The above patents, and, in particular, the French Patent Application 90 13137 (Claude Ricard) teach methods and devices for preparing cable bundles.

However, automatic wiring machines made according to these patents only produce bundles in which the interconnection of multiple ends have been completed. U.S. Pat. No. 5,083,369 to Cerda which proceeds in a different manner than the prior art devices discussed above, is directed to a method and a device wherein a wiring harness made up of a plurality of sections of wire is first produced and then the common ends of the harness further engaged to different connectors for later engagement to electrical equipment to be interconnected as a system.

Although, all the above prior art have made it possible to automate part of the production which was previously performed largely by hand, the bundles made with connectors engaged must be manually separated into branches by creating bypasses or nodes, and then the wires from different branches interconnected or as in the Cerda patent the bundles made without connectors must have branch ends manually engaged to the connectors.

OBJECTIVES OF THE INVENTION

One object of this invention is to provide automatic wiring machines for the automatic production of conductor wire or optical fiber bundles having predetermined branches.

Another object of the invention is to create automatic wiring machines as above which produce bundles in which the wires in the same branch are interconnected.

Another object of the invention is to make flexible machines which allow the different branches to be made automatically.

SUMMARY OF THE INVENTION

The method and device according to the claimed invention incorporates in its first step the method and devices from the French Patent 90 13137 discussed above which automatically begin the making of cable bundles or wiring harnesses by first gathering multiple ends of selected wire sections of the bundle and engage them either in an end clamp for transfer by a supply conveyor or in a connector which is then engaged in a component clamp for transfer by the same supply conveyor. The remaining portions of the method and device according to the claimed invention are novel improvements to the above discussed French Patent application FR 90 131137 method and device.

For purposes of better describing the claimed invention, as used herein after the term "node" refers to a point in a bundle of conductors at which two or more small bundles or branches join to form a larger bundle, or alternately, a point at which a bundle separates into two or more smaller bundles or branches.

Advantageously, a first embodiment of a device according to the invention which permits performance of the method according to the invention comprises:

a supply conveyor which transports and transfers to a grid, the end and component clamps in which wire ends of a plurality of wire sections comprising a predetermined number of branches of the wire bundle or harness are connected, as shown in French Patent Application FR 90 13137;

a grid comprising multiple sets of conveyors, each set of conveyors comprising, 1) a first conveyor for transporting the clamps supplied from the supply conveyor along its length;

2) a second conveyor for transporting guide rods that define the nodes or starting points of the predetermined number of branches of the wire bundle; and 3) a third conveyor for transporting a transfer carriage along its length. The transfer carriage having means for transferring the clamps supplied to a first conveyor of one set of conveyors to another first conveyor of an adjacent set of conveyors and means for lifting the guide rods engagement on the second conveyor;

drive means to drive all the conveyors; and a programmed computer to actuate the drive means, and the means on the transfer carriage to transfer clamps and engage guide rods.

According to this preferential embodiment, at least one of the multiple sets of identical conveyers is positioned as an extension of the supply conveyor.

In a second embodiment of the invention a supply conveyor is substituted for that of French Patent Application FR 90 13137 which positions nodes of the branches in end clamps identical to those used to transport the ends of other selected wire sections of the bundle.

This embodiment also includes means to unwind selected wire sections and stop the wire at points corresponding to the nodes of the branches.

The use of the second embodiment is intended to limit the use of the guide rods used in the first embodiment.

Either embodiment is intended to permit the automatic production of bundles and the automation of part of the production which in the past has been performed essentially by hand, i.e., separation of branches, creation of the branch nodes or bypasses and interconnection of wires in the same branch.

This result also makes it possible to produce bundles which are easier to store because the wires of different branches no longer have the same tendency to become tangled with their connectors. This enables economies and enhanced quality in the making of wiring harnesses.

The following description refers to the accompanying drawings, which provide strictly non-limitative sample embodiments of devices according to the invention.

PREFERRED EMBODIMENTS OF THE INVENTION

Figure 1:
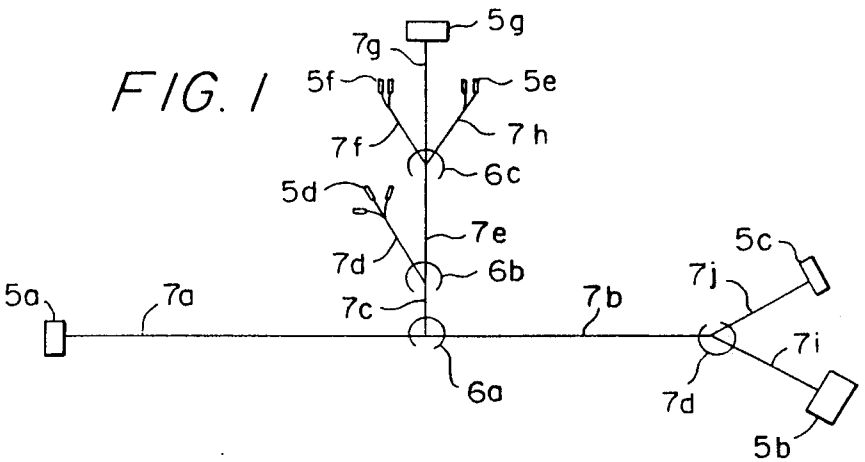
FIG. 1 shows an example of a wire bundle comprising different branches which could be produced by the automatic wire bundling method and machine according to the invention.
Figure 2:
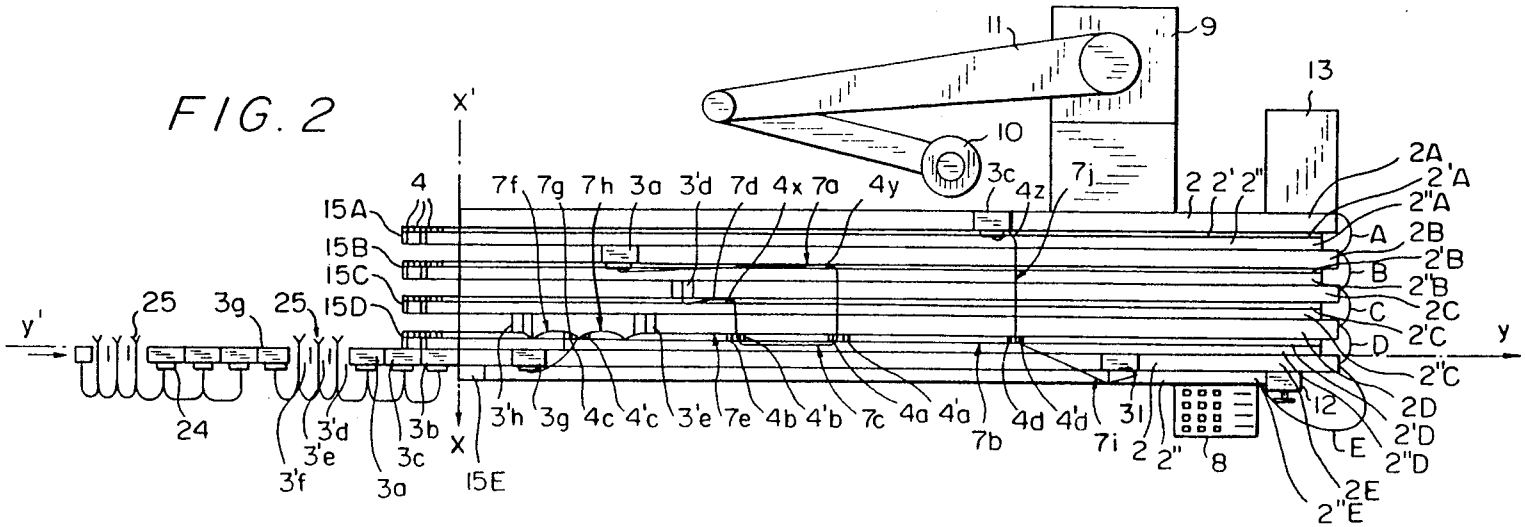
FIGS. 2 and 3 are partial schematic plane views, from the top and elevation, of an overall device according to the invention in the process of making bundles such as, the example of FIG. 1 according to the first embodiment.
Figure 3:
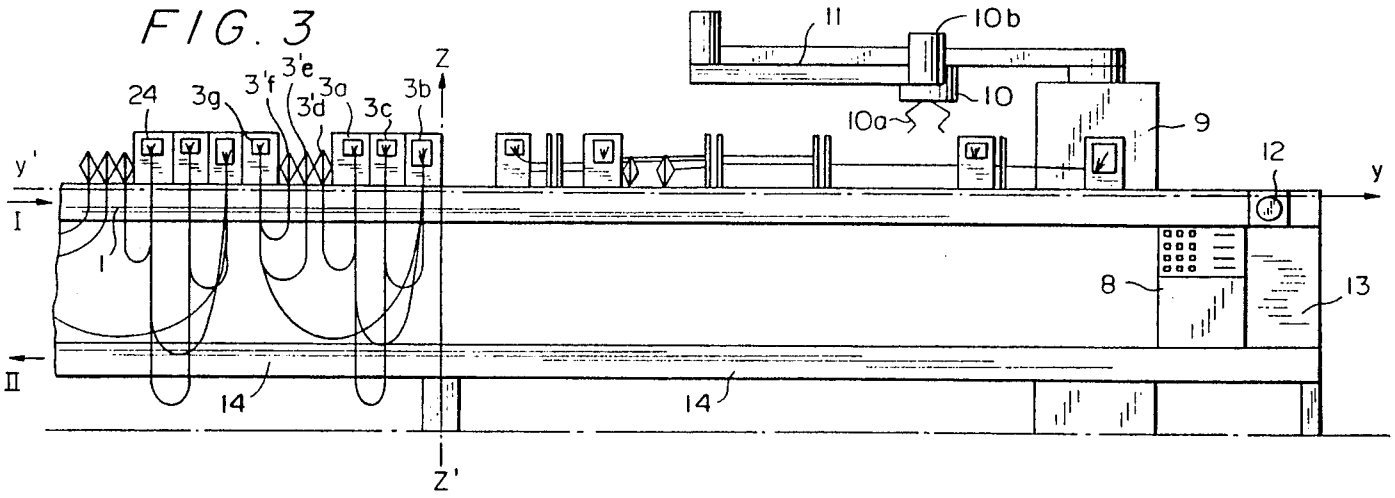

FIGS. 2 and 3 show a device according to the invention in the process of producing the bundle shown in FIG. 1.

According to the example in these figures, a supply conveyor (1) transports, along the (Y'Y) axis or in the downstream direction, ends of a predetermined number of branches of a wire bundle connected in component clamps (3) such as (3*a*), and unconnected ends held in end clamps (3'), such as (3'*f*).

After the wiring harness is produced by the method and device according to the invention , all component clamps and all end clamps are disengaged from the branch ends leaving the components and unconnected ends for engagement to interconnect the equipment intended to form a desired system.

The supply conveyor (1) is only partially shown as it is not considered a novel feature of the claimed invention and is shown in patents (C. Ricard) FR 90 13137 and FR 2619258 which teach the following functions:

Connection of the branch ends in connectors held by clamps (3*g*), (3*a*), (3*c*), (3*b*); and Connection of wire ends in end clamps (3'*f*), (3'*e*), (3'*d*).

This upstream supply conveyor, delivers the clamps along reference plane (I) and receives unloaded and empty clamps along reference plane (II) to recycle them as recommended in Patent FR 90 13137.

Supply conveyor (1), as shown in FIG. 2 and 3 is endowed with end clamps (3') making it possible to transport ends (25), and connector clamps (3) making it possible to transport connectors (24) to which some ends are connected.

The object of this invention is to provide means to make it possible to build automatic wiring machines for the automatic production of conductor wire or optical fiber bundles with branches. This machine produces separated branches having wires in each branch interconnected.

As indicated, devices shown in FR 90 13137 make it possible to interconnect the components of a bundle, but do not teach thereafter forming the branches of said bundle.

Figure 16:
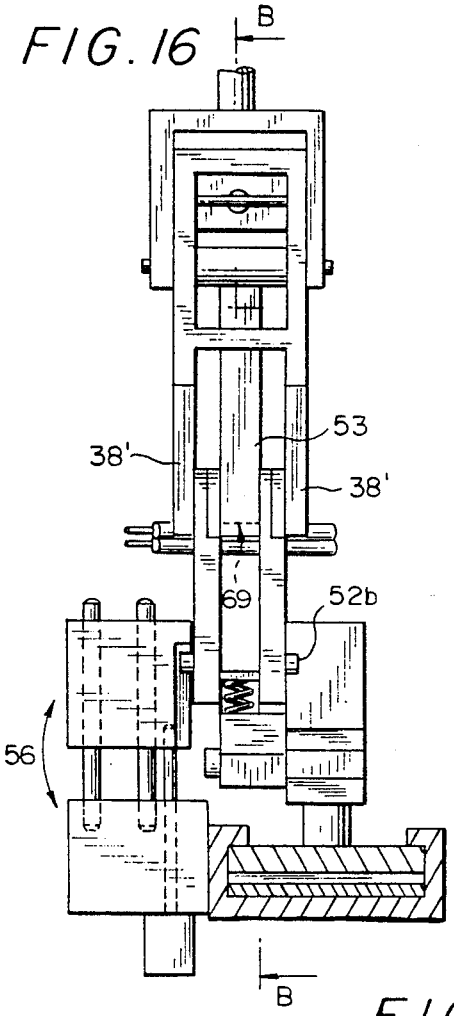
FIGS. 16 and 17 show, a prior art gripper for positioning one or more wires in an end clamp, in the process of positioning a wire end in a clamp, from a side view and along a partial cut in elevation.
Figure 17:
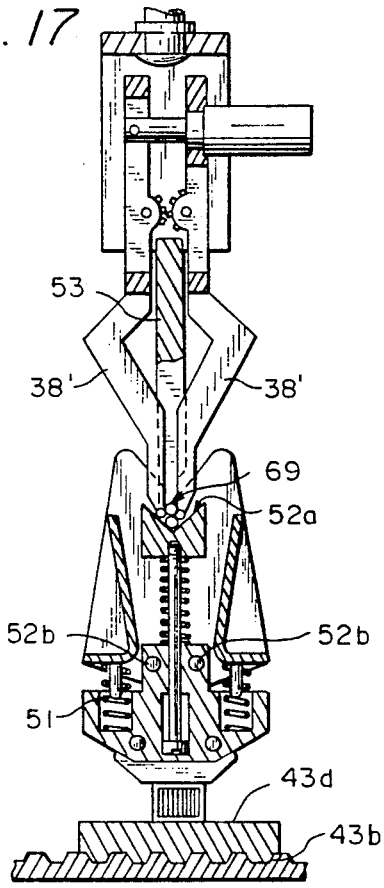

Patent FR 2619258 describes a device for grouping several wires together in one end clamp. However, it does not teach a gripper which places several wires in the same end clamp. A gripper that places several wires in the same end clamp is shown in FIGS. 16 and 17.

In the invention claimed, the components engaging ends of the branches for transport are held by component clamps (3) and the unconnected ends are held in end clamps (3') so that components (24) and unconnected ends (25) corresponding to different branches of the bundle are placed in different clamps.

In the example shown in FIGS. 2 and 3, each end (5*a*), (5*b*), (5*c*), (5*d*), (5*e*), (5*f*) and (5*g*) of the example wire bundle of FIG. 1 is shown respectively engaged to a corresponding individual clamp (3*a*), (3*b*), (3*c*), (3'*d*), (3'*e*), (3'*f*) and (3'*g*).

Figure 4:
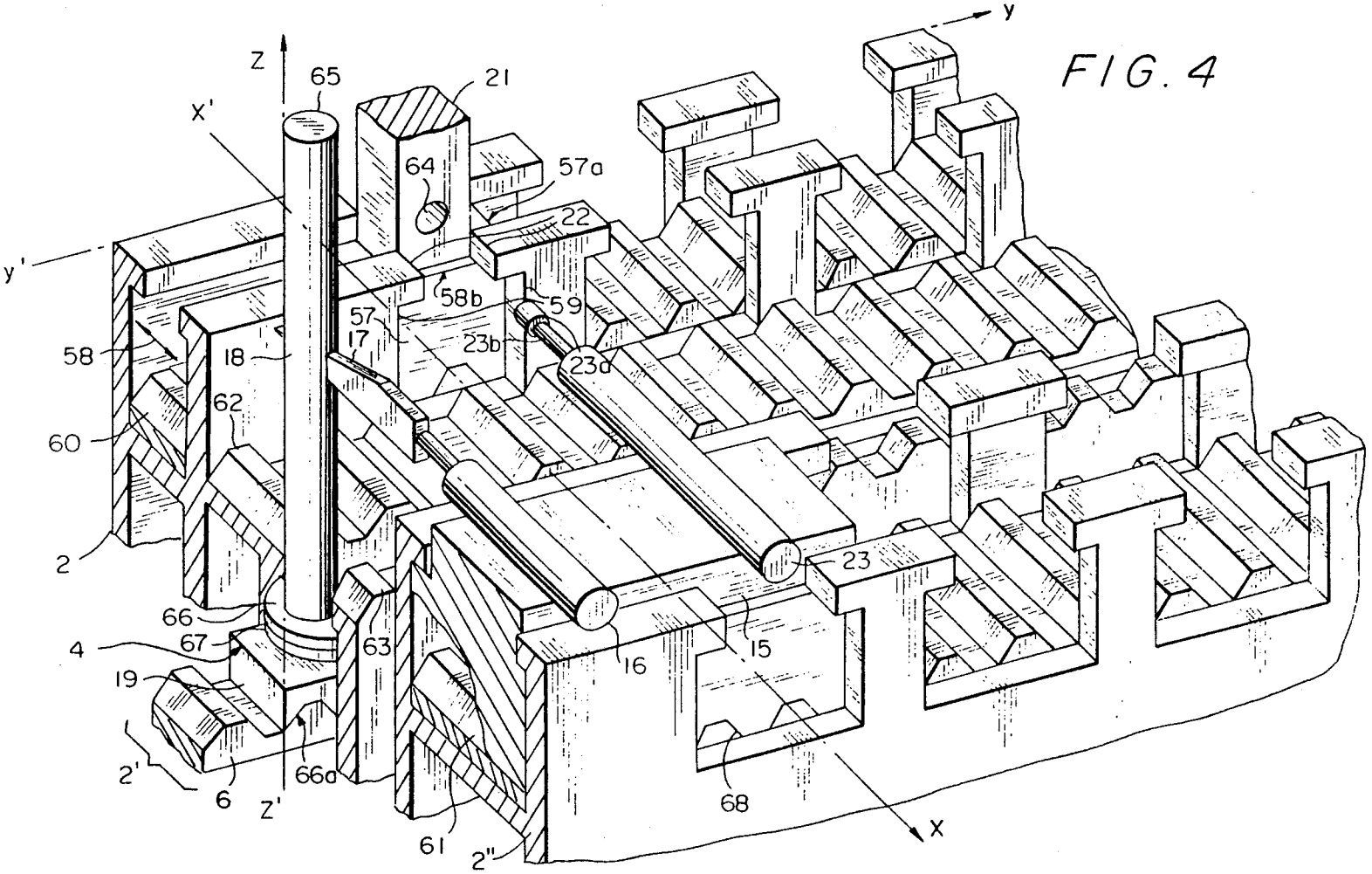
FIGS. 4 shows a perspective detailed view and partial transverse section of one set of the three conveyors comprising the multiple sets of conveyors shown in FIG. 2.

FIGS. 2 and 4 show how the example wire bundles of FIG. 1, after its ends (5*a-g*) are respectively engaged to corresponding clamps on supply conveyor (1) are arranged on conveyor (1) and thereafter on grid A-E after distribution by the multiple sets of conveyors A-E under the control of computer 8.

One of the sets of the conveyors is shown in detail in FIG. 4. As shown in FIG. 4, each set of the sets of conveyors (with the exception of conveyor E adjacent supply conveyor) comprises;

1) a first clamp conveyor 2 for transporting the clamps supplied from the supply conveyor 1 along its length. Each component clamp 3 or end clamp 3' has an identical base or foot 21 which engages corresponding track 60 of first conveyor 2;

2) a second guide rod conveyor 2' for transporting guide rods that define the nodes of the predetermined number of branches of the wire bundle;

3) a third conveyor 2'' for transporting a transfer carriage 15 along its length. Transfer carriage 15 carries means for transferring the clamps supplied to the first conveyor 2 to an adjacent first conveyor 2 of set of the sets of identical conveyors. Transfer carriage 15 also carries means for transferring the guide rods into engagement with the second conveyor 2'; and 4) drive means to drive the conveyors (not shown);

Each conveyor 2, 2' and 2'' and the means on the transfer carriage 15 to transfer clamps and engage guide rods is controlled by programmed computer 8.

The carriage (15) transports means to position the guide rods and clamps comprising jacks (23) and (16).

The first conveyor 2 transports component and end clamps through the use of belt (60). In FIG. 4 only a foot 21 identical in each of such clamps is shown. Foot 21 comprises a sole plate (57) whose width (57*a*) is slightly smaller than the width (58) of conveyor 2 so that the base can be guided effectively in the section.

Length (57*b*) is slightly shorter than the length of a notch (58) to allow the clamp to be transferred along the (X'X) axis. This transfer is performed by sliding the clamp by either pulling or pushing. The teeth 43(*b*) of the base 43(*d*) shown in FIG. 22 then slide on the teeth of belts (60) and (61), and on the teeth of intermediate racks (62) and (63) cut in the section. The teeth of the belts, in clamp transfer position, and the teeth of said racks, are aligned.

A selected clamp is pushed using jack (23), or is pulled with said jack and elastic component (23*a*). Jack (23) telescopes to move clamps off of any first clamp conveyor 2 to other clamp conveyors 2 within its span. In this way, a clamp can be moved the full width of grid A-E by the use of the jacks corresponding to the conveyors 2''A-2''E. Said device (23*a*) is made of a hollow elastic rubber component. Said component may be pressurized and inflated like a balloon by injecting compressed air into it through hollow axis (23*b*). Said component can also be left at rest by placement to open air. At rest, said device (23*a*) freely enters the corresponding hole (64) with which clamp (3*a*) is endowed. After having engaged in said hole, it is inflated and expanded by injection of compressed air, which allows jack (23) to pull clamp (3).

Carriage (15) is made according to FIG. 4. It comprises teeth (68) meshed with the teeth of synchronous belt (61) of conveyor 2''. Said belt, which forms a motor-driven loop, makes it possible to move carriage (15) and to bring the axis of the jack it holds in correspondence with the axis of hole (64).

The displacement of conveyor 2'' also makes it possible to bring carriage 15 opposite a guide rod 4 so as to align wedge (17) with opening (18).

Foot (19) is held in contact with the synchronous belt through the use of friction washer (66) and elastic component (67).

The emergence of jack (16) engages said wedge (17) in opening (18). Wedge (17) raises rod (65) and foot (19) while compressing the elastic piece or spring (67). Teeth (66*a*) of foot (19) disengage from complementary teeth (66*b*) of synchronous belt (20). After these teeth have disengaged, carriage (15) allows stop (4) to move along conveyor 2'.

According to the embodiment in FIG. 2, the bundle of FIG. 1 is run over the set of conveyors A-E so that the different branches are simultaneously strung between the clamps, and through the use of guide rods (4) which engage the nodes of the branches of the bundle.

Guide rods such as (4*c*), (4'*c*) or such as (4*b*), (4'*b*) are placed at selected locations which correspond to nodes (6*c*) and (6*b*) of the bundle shown in FIG. 1. In association with clamps such as (3*g*), (3'*f*) and (3'*e*), also placed at predefined locations, these guide rods hold the corresponding branches, such as (7*g*), (7*f*), and (7*h*) in strung position.

For example, guide rod (4*c*) placed on conveyor 2'D and component clamp (3'*f*) placed on conveyor 2D have selected positions so that branch (7*f*) is strung in a predetermined manner. Guide rod (4*c*) is in contact with branch (7*f*) at the node on, said branch corresponding to the length of said branch (7*d*).

Other guide rods such as (4*x*), (4*y*) and (4*z*) do not correspond to nodes. They are advantageously placed at selected locations to fold branches (7*d*), (7*a*) and (7*j*). For example, predetermined positions of component clamp (3*a*) of guide rod (4*y*) and guide rods (4*d*), (4'*d*) are such that guide rods (4*d*) and (4'*d*) are in contact with branch (7*j*) at the node or said branch which corresponds to the length of said branch (7*j*). Said branch is folded by guide rod (4*z*).

According to an advantageous embodiment in the case of this particular sample embodiment in the case of said mechanisms to move said clamps apart comprise multiple guide rods (4) which engage and arrange branches (7) of the bundle.

According to FIG. 2, different clamps and guide rods are arranged on conveyor 2 and conveyor 2'D at predetermined locations. From upstream to downstream, we note in the following order: component clamp (3*g*), pairs of guide rods (4*c*) and (4'*c*), (4*b*) and (4'*b*), (4*a*) and (4'*a*), (4*d*) and (4'*d*), and component clamp (3*b*). Said guide rods and clamps are placed along parallel and neighboring conveyors in approximately the same direction.

As shown in FIG. 2, branches (7*g*), (7*e*), (7*c*), (7*b*) and (7*i*) are strung by the unit composed of second conveyor 2D and conveyor 2'D. Advantageously, in this manner, one of the sets of branches composed of the greatest number of contiguous branches is strung along the same second conveyor or in approximately the same direction.

For the bundle shown in FIG. 1, such a set of branches composed of the greatest number of contiguous branches is shown on conveyors: (7*g*), (7*e*), (7*c*), (7*b*) and (7*i*).

Such a unit is not unique in the example of bundle of FIG. 1. Another such set is (7*h*), (7*e*), (7*c*), (7*b*) and (7*j*).

Among several units composed of the greatest number of contiguous branches, it is advantageous to choose the one which comprises the greatest number of wire sections, counting the number of wire sections in each branch and totalling all of these subtotals for all branches.

As shown in FIG. 2, the bundle of FIG. 1 is arranged on grid A–E with a base trunk which is composed of branches (7*g*), (7*e*), (7*c*), (7*b*) and (7*i*) and a set of branches (7*f*), (7*h*), (7*d*), (7*a*) and (7*j*) on a second level.

Alternatively a bundle run on conveyors A–E and formed according to the geometric configuration shown in FIG. 1 would include a base trunk composed of branches (7*a*), (7*b*) and (7*i*); two level 1 branches (7*c*), and (7*j*); two level 2 branches (7*d*) and (7*e*); and three level 3 branches (7*f*), (7*g*) and (7*h*).

FIGS. 2 and 3 show the device which fastens the wires in the same branch together. It comprises a commercial robot (9) endowed with an arm (11) which under the control of computer (8) can fasten a clip to any point on conveyors A–E and thereby attach the wires in the same branch together. A commercial model link connector, is positioned over the point of the branch to be linked. It is guided by motor (10*b*) depending on the direction of the branch to be linked. It is then lowered so as to place the set of wires of the branch in jaws (10*a*) which connect the wires of the branch together with a clamp when they close. The link connector installs the link, the jaws are reopened, and the link connector withdrawn. All of these operations are performed under the control of computer (8) which executes a predetermined program.

When the bundle is entirely formed and linked, the computer suspends the operation of the device. An operator withdraws the components held by clamps (3*g*), (3*a*), (3*c*), (3*b*) and the ends grouped in the end clamps (3'*f*), (3'*e*), (3'*d*). The operator thus has a bundle of conductor wires or optical fibers whose branches are formed and connected. The operator then presses on push button (12) which informs computer (8) that the clamps are empty and computer (8) resumes the execution of the predetermined program.

Computer (8) then orders conveyor 2A to transfer component clip (3*c*) in the direction of axis (Y'Y) to the downstream end of said conveyor. It then orders the system for removing clamps (13) to return conveyor (14). Said devices (13), (14) are made according to French patent application FR 90 13137 (Claude Ricard) or a commercially-available manipulator. They send empty clamps back to the upstream part of the device. Conveyor (1) is incorporated into said upstream device, which is shown only partially in FIGS. 2 and 3.

As shown in FIG. 4, computer 8 can successively order the following on any of the multiple sets of identical conveyors shown in FIG. 2:

Movement of conveyor 2" to bring carriage (15) opposite guide rod (4).

As shown in FIG. 4, emergence of jack (16) which unlocks said guide rod from the synchronous belt through the action of wedge (17), which, penetrating opening (18), raises the foot and disengages it from the synchronous belt. The insertion of the wedge also enables carriage (15) to move guide rod 4 along conveyor 2'.

Displacement of conveyor 2' which returns guide rod with other stops stored at the upstream end of said conveyor. The guide rods are stored in this way, in a regular step which is a multiple of the step of the synchronous belt to which they are locked at the upstream end of conveyors 2'.

The reentry of jack (16) which disengages wedge (17) and which locks the guide rod on conveyor 2' in said storage position.

Similarly, computer (8) orders all guide rods 4 on the different conveyors 2' to be transferred to storage position.

Computer (8) orders conveyor 2 to bring foot (21), shown in FIG. 4, of component clamp (3*a*) opposite slot (22) located immediately downstream. The computer orders conveyor 2" to bring carriage (15) opposite component clamp (3*a*) and activates jack (23) held by said carriage which pushes the component clamp on the synchronous belt of the conveyor. The teeth of said belt are in alignment with those of conveyor belt 2 and in alignment with the belts of different conveyors 2 and 2" when they are stopped. The teeth of the clamp base slide thereon. The course of jack (23) is such that the clamp is pushed into the axis of conveyor 2 through openings (59) cut out regularly in all sections forming conveyors 2 and 2". Conveyors 2' are located at a lower level so as not to impede the movement of the clamps along the (XX') axis. In the same way it ejects clamp (3*c*) from the conveyor, the computer orders the ejection of clamp (3*a*) carried on conveyor (2*e*).

As shown in FIG. 4, the grid A–E for moving the clamps apart and to stringing the bundle branches is made by juxtaposition of multiple sets of identical conveyors A, B, C and D, each set of which has, 1) a first clamp conveyor 2 for transporting the clamps supplied from the supply conveyor 1 along the length of the first clamp conveyor 2, 2) a second guide rod conveyor 2' for transporting guide rods that define the nodes of the predetermined number of branches or assist in folding the branches of the wire bundle, and 3) a third carriage conveyor 2'' for transporting a transfer carriage along its length.

Conveyor E however, comprises only a first clamp conveyor 2 which is an extension of supply conveyor 1 and a third carriage conveyor 2'' for transferring clamps to other clamp conveyors 2 on the grid A–E. Conveyor E therefore does not have a second guide conveyor 2' as guide rods are unnecessary for positioning clamps on conveyor E. Further carriage 15E on carriage conveyor 2'' of conveyor E therefore has no jack 16 to lift guide rods 4.

This method of making the mechanism to form the bundles is advantageous because of its modularity and flexibility.

In the same way as it ordered clamp (3*a*) to be transferred to clamp conveyor 2A, then that it be ejected to return conveyor (14) using mechanisms of the same type, computer (8) orders that all clamps be transferred to conveyor 2A in a succession of transfers from conveyor to conveyor, and finally that they will be ejected to return conveyor (14).

At this phase of sequential bundle production, conveyors (2) are free of all clamps, the guide rods 4 are stored at the upstream end of conveyors (2') according to a regular step and carriages (15) are placed at the upstream end of conveyors (2'').

On supply conveyor (1), all components and section ends corresponding to different bundle branches held in different clamps are ready.

The clamps are advantageously arranged on the supply conveyor (1) according to the nodes on the trunk of the bypass in which the branch connecting the clamp to the trunk ends.

When there is a subset of branches at least one of which is of an order greater than one at a point of attachment, it is advantageous to repeat the same treatment for said subset. This involves placing the longest trunk in said set along the same axis. The constituent clamps are arranged on supply conveyor (1) according to the same rule.

The branches of this set are advantageously treated by defining a secondary base trunk and by stringing one of the sets of branches composed of the greatest number of contiguous branches along a same clamp conveyor (2) or approximately in the same direction.

The configuration of the bundle of FIG. 1 as shown on grid A–E of FIG. 2 results from the following actions. If computer (8) centralizes the monitoring and control of the upstream part (not shown) and supply conveyor (1), it directly controls conveyor (1). Otherwise, it performs this operation through the intermediary of the computer which monitors and controls this upstream part. This control also sets conveyor (2E) into motion synchronously with conveyor (1) so that the two belts of the same type with which they are equipped transfer the first clamp of bundle (3*b*) of conveyor (1) to conveyor (2E). It is advantageous for one computer to supervise the overall operation of the decentralized racks 16, 23 on different units.

The computer controls carriage conveyor (2''D) which moves carriage (15D) and jack (16) to transport and lock:

Step 1

A first guide rod (4'*d*) is moved along conveyor (2''D).

Step 2

A second guide rod (4*d*) is moved along conveyor 2''D leaving a space between (4*d*) and (4'*d*) to permit clamp (3*c*) to slide along the (XX') axis between these guide rods.

Step 3

Conveyor (2E) is activated and moves clamp (3*b*) downstream by a distance equal to the length of branch (7*i*).

Step 4

Guide rod (4*z*) is transported and locked on the belt of conveyor (2'A) upstream therefrom through using carriage (15A) and conveyor (2''A).

Step 5

The computer synchronously orders supply conveyor (1) and (2E) to transfer clamp (3*c*) to conveyor (2E) and to bring it between the two guide rods (4*d*) and (4'*d*). Clamp (3*c*) is thus placed between guide rods (4*d*) and (4'*d*) and the foot of said clamp is opposite one of openings (22).

Step 6

The computer orders the different conveyors (2''E), (2''D), (2''C), (2''B) and their respective carriages (15) and jacks (23) to transfer clamp (3*c*) along the (XX') axis to conveyor (2*a*).

All conveyors (2E), (2D), (2C), and (2B) are moved simultaneously downstream in order to string branch (7*j*). The relative positions of clamps (3*c*), (3*b*), and guide rods (4*z*), (4*d*) with respect to each other are as shown in FIG. 2 within one translation and with the exception of guide rod (4'*d*) which is offset.

The computer then orders conveyor (2''D) and jack (23) of carriage (15D) to move guide rod (4'*d*) upstream and to bring it closer to guide rod (4*d*) as shown in FIG. (2).

At said stage of bundle formation, i.e., its geometric shaping, component clamps (3*b*) and (4*z*), guide rods (4*d*), (4'*d*), and (4*z*) are in the same positions as in FIG. 2 within one translation along the (Y'Y) axis.

The computer then synchronously offsets all conveyors (2), (2'), and (2''), to offset the portion of the bundle which has already been formed in the downstream direction and so that the node of guide rod (4*d*) is equal to the distance between guide rods (4*a*) and (4*d*) in FIG. 2. The unused guide rods are returned upstream using carriages (15) and conveyors (2').

According to a process identical to those described above, guide rods (4*a*) and (4'*a*) are positioned while leaving space for clamp (3*a*) to slide between them. Guide rod (4*y*) and clamp (3*a*) are positioned. The computer then synchronously offsets all conveyors (2), (2'), and (2'') with the exception of conveyor (2B) which holds clamp (3*a*), which is held immobile, in order to offset the portion of the bundle which is already formed in the downstream direction and so as to string branch (7*a*). Guide rod (4'*a*) is returned upstream as above for guide rod (4'*d*).

At this stage, these different elements and those already positioned are arranged on various conveyors (2) as shown in FIG. 2.

Clamp (3'*d*) and the corresponding stops are positioned in exactly the same way.

Clamps (3'*f*) and (3'*e*) could be positioned in the same way as the preceding clamps by placing each of said clamps on other conveyors (2). According to another advantageous method for forming the branches which reduces the number of conveyors (2) needed, it is preferable to arrange them as shown in FIG. 2. For this purpose, the computer issues the following sequence of commands:

Synchronous movement of all conveyors (2), (2'), and (2") in order to transfer clamps (3'*f*) and (3'*e*), moved apart as shown in FIG. 2, on conveyor (2E). This movement simultaneously offsets the portion of the bundle already formed in the downstream direction. The movement is such that the node of guide rod (4*b*) is greater than the distance between the extreme ends of clamps (3'*f*) and (3'*e*) as shown in FIG. 2.

The positioning of guide rod (4'*c*) immediately upstream from guide rod (4*b*), and of guide rod (4*c*) immediately upstream from node 0 on conveyor (2'D). In this way, the spacing of these two guide rods is greater than the space requirement of clamps (3'*f*) and (3'*e*).

The transfer of clamps (3'*f*) and (3'*e*) on conveyor (2D).

The synchronous transfer of all conveyors (2), (2') and (2") with the exception of conveyor (2D) carrying clamps (3'*f*) and (3'*e*) which are held immobile, in order to offset the portion of the bundle already formed in the downstream direction and to string branch (7*e*). The supply conveyor, is also controlled synchronously during this transfer. It transfers clamp (3*g*) to conveyor (2E) so that the distance between clamp (3*g*) and guide rod (4*b*) is as shown in FIG. 2.

The transfer of guide rods (4*c*) and (4'*c*) to their relative locations as shown in FIG. 2.

At this stage, all elements are arranged on conveyors (2) in the same manner as shown in FIG. 2.

It is of course possible to program computer 8 to arrive at the same result as shown in FIG. 2 by a different process.

Figure 5:
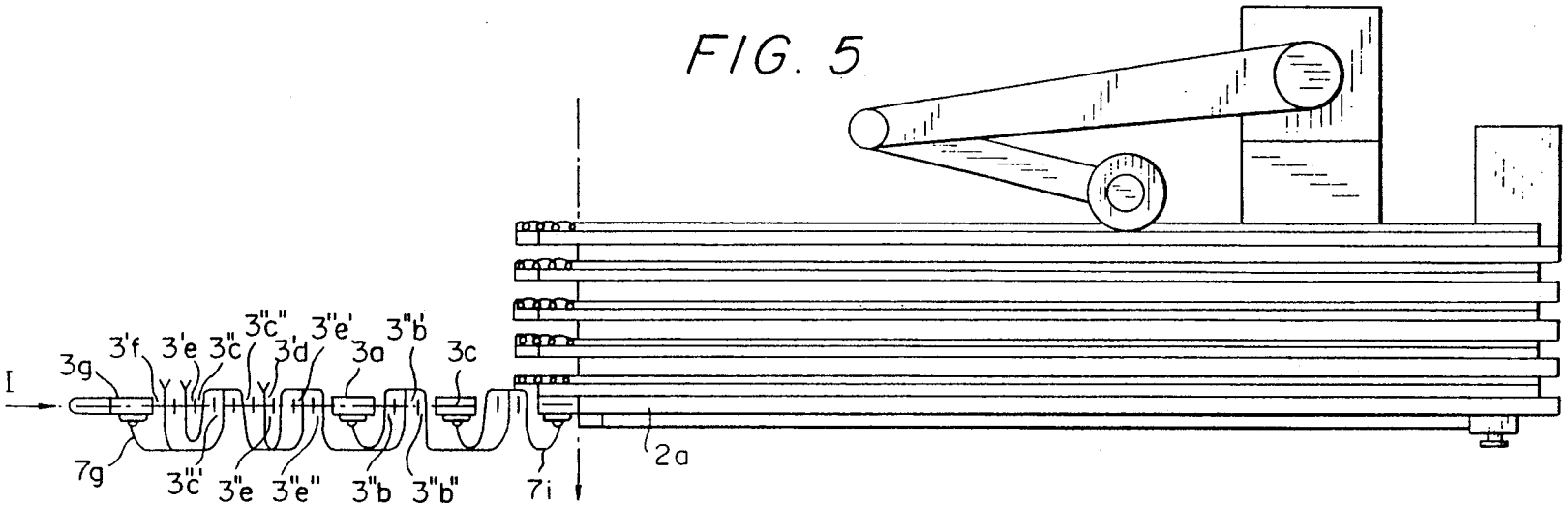
FIG. 5 and 6 are also partial schematic plane views, from the top and elevation, of an overall device in the process of making bundles such as, the example in FIG. 1 using ends clamps engaging the nodes of the preselected branches according to the second embodiment.
Figure 6:
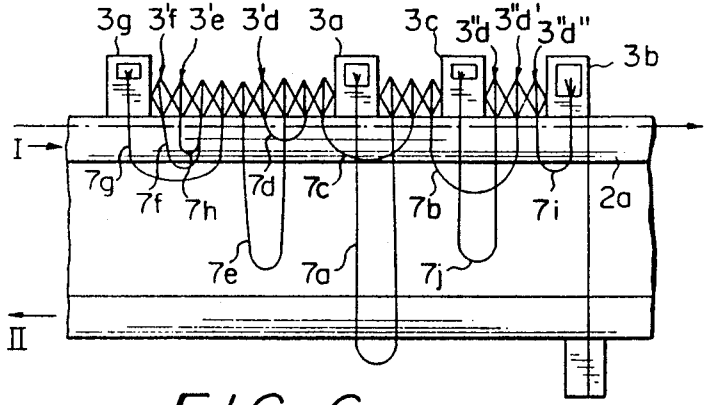

FIGS. 5 and 6 provide partial, schematic, plane views, from the top and elevation, of a device similar to the one shown in FIGS. 2 and 3. This device is shown in the process of making bundles such as the one described in FIG. 1. This device is a special embodiment of the invention which uses bypass clamps.

These figures show that all components in the bundle are held as previously by clamps (3*g*), (3'*f*), (3'*e*), (3'*d*), (3*a*), and (3*c*). The branches are held either by group clamps (3'), by component clamps (3), or, finally, by bypass clamps (3"): branch (7*g*) between (3*g*) and (3"*c*'), branch (7*e*) between (3"*c*') and (3"*e*), etc.

Figure 22:
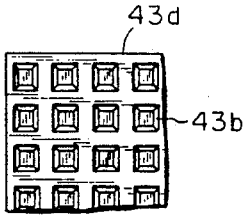
FIG. 22 is a detail view of the base common to the end clamps of FIGS. 18 and 19, the component clamp of FIGS. 20 and 21 and the group clamp of FIGS. 23 and 24.
Figure 18:
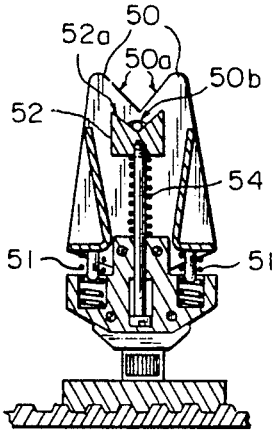
FIGS. 18 and 19 show an end clamp from a side view and along a partial elevation cut.
Figure 19:
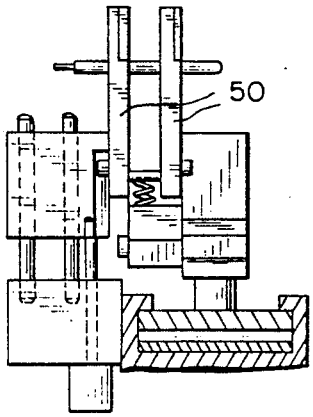
Figure 20:
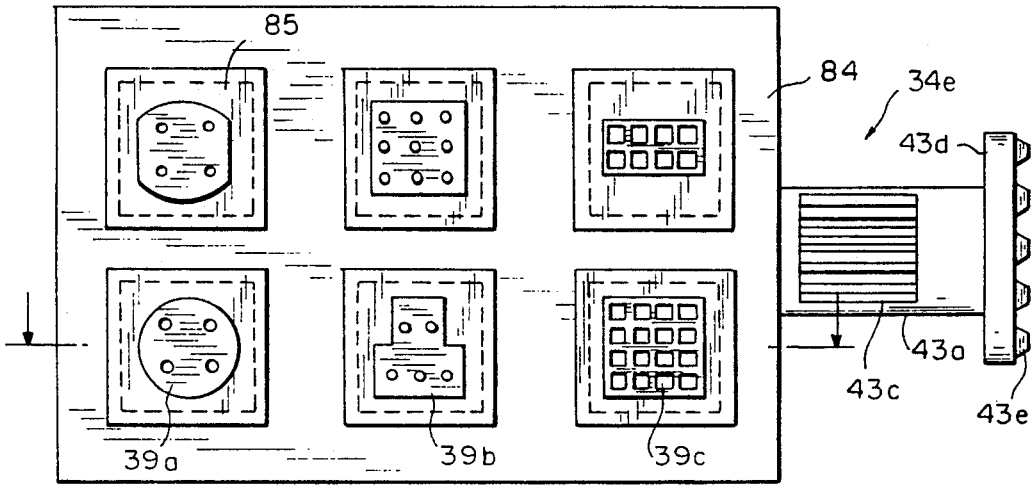
FIGS. 20 and 21 show a component clamp from a side view and along a partial elevation cut.
Figure 21:
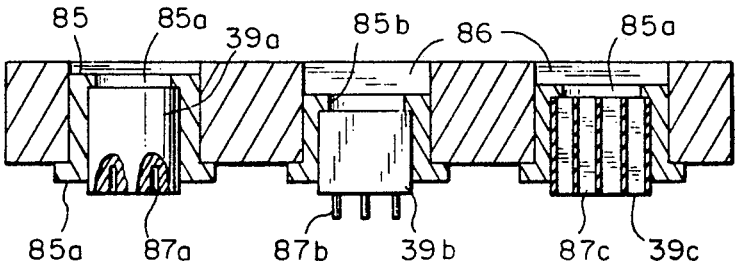
Figure 25:
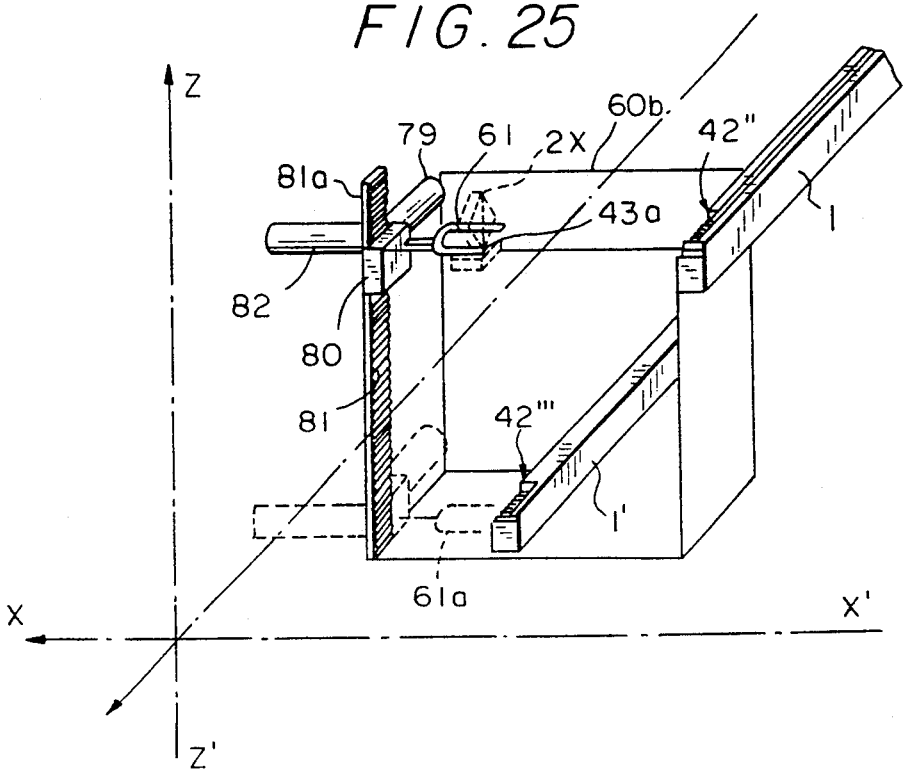
FIG. 25 shows a perspective view of a mechanism for moving clamps between different conveyors.

Bypass clamps (3"), end clamps, and group clamps (3') are advantageously identical as shown in FIGS. 18, 19 and 22 in regard to elements (43*a*), (43*b*), (43*c*) and (43*d*).

According to the example shown in FIGS. 5 and 6, bypass clamps (3"), designed to grasp and hold several wires, hold the set of wires of a branch at intermediary points which are associated with branches of the desired wiring banners.

According to the advantageous embodiment shown, the branch wires of a branch are held separately, branch by branch, in several contiguously-arranged bypass clamps (3") such as (3"*c*), (3"*c*'), (3"*c*"). Said clamps have a given space requirement and there is a minimum length of wire inside or between their jaws. Within this space requirement, said bypass clamps grasp the wires at the same points as those which were in contact with the guide rods as shown in FIGS. 2 and 3.

Figure 23:
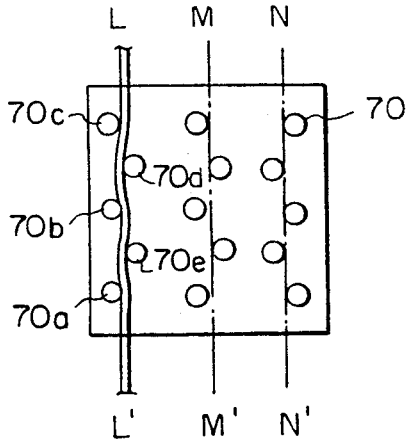
FIGS. 23 and 24 show a plan view and elevation view of a group clamp.
Figure 24:
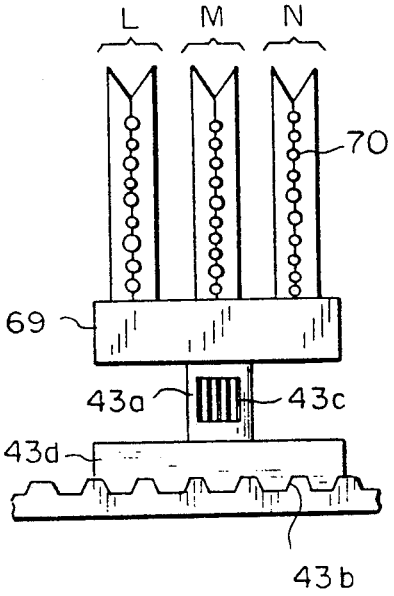

According to a variation of the invention, said contiguous clamps can be grouped together into a single device, and, in particular, clamps can be used for this purpose to enable the grasping and holding of several wires in a given order in a limited space. The clamps of this type described in Patent Application FR 90 13137 (Claude RICARD) are particularly advantageous and are shown in FIGS. 23 and 24.

The unusable lengths inherent in said space requirement depend on the embodiment and arrangement of said clamps.

Within these unusable lengths, said intermediary points, which are associated with bypasses and which are held by said bypass clamps, there are also bypass points designated by reference (6*a* to 6*c*) in FIG. 1.

Figure 7:
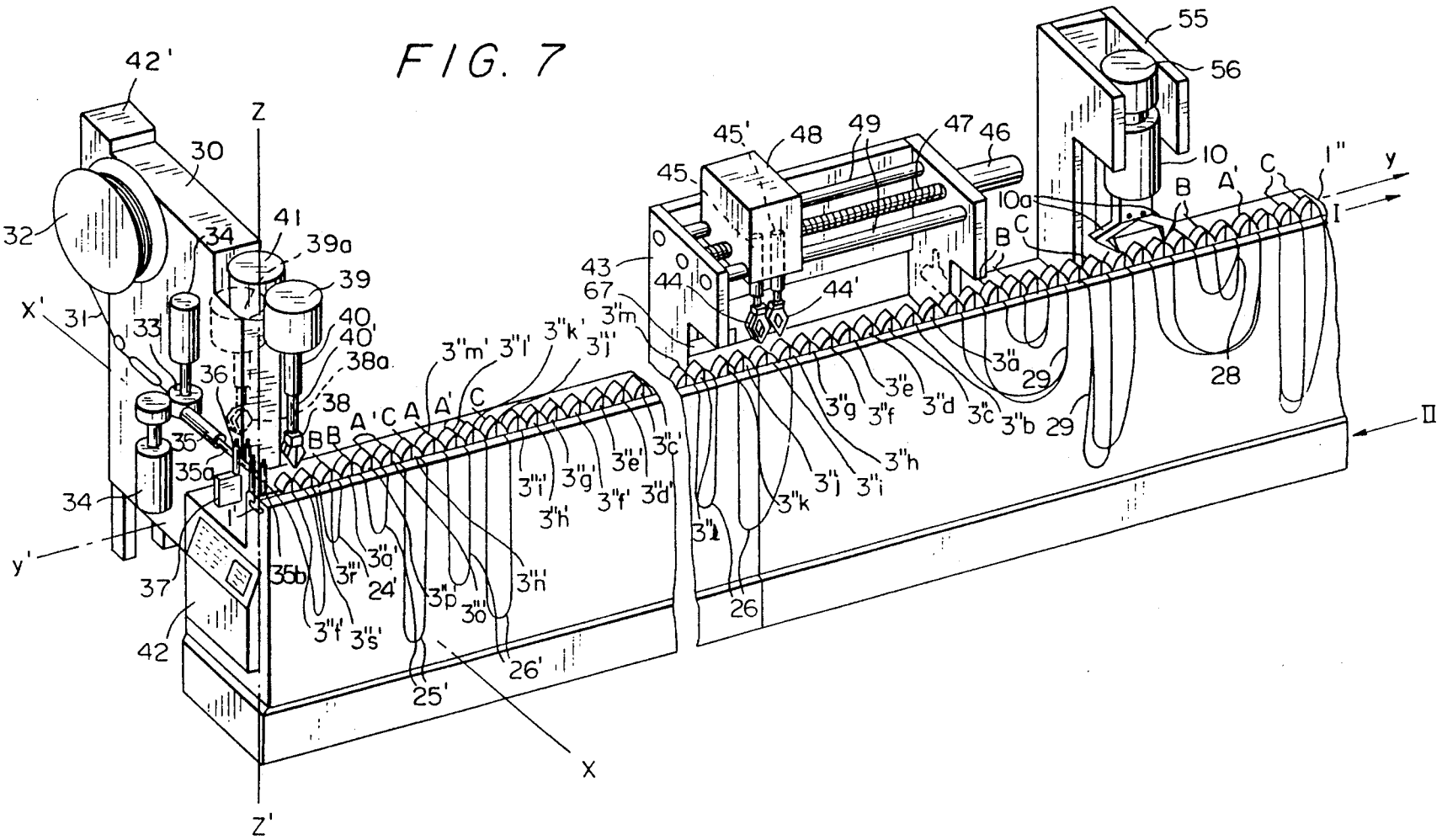
FIG. 7 is a schematic, partial, and perspective view of the supply conveyor used with the second embodiment according to to the invention for placement of the nodes of the preselected branches in end clamps.

The upstream part which delivers said clamps according to reference (I) and which receives the unloaded clamps according to reference (II) to recycle them is shown in FIG. 7.

Advantageously, according to this particular embodiment of the process, it is no longer necessary to run the entire bundle in a configuration which strings all of the branches simultaneously. According to the embodiment in FIG. 5, only said bypass clamps with the different other clamps are moved apart to shape the bundle, and advantageously the different branches are strung and if applicable linked one after the other.

Advantageously, as for the device shown in FIGS. 2 and 3, and in the same manner, one of the sets of branches composed of the greatest number of contiguous branches is strung along the same conveyor 2 or approximately in the same direction.

According to the first phase of the example in which the bundle of FIG. 1 is formed, stop (4*w*) is positioned as shown above using carriage (15E) and conveyor (2"D). Conveyors (1) and (2E) are driven synchronously in order to transfer the set of clamps and to make the configuration shown in FIG. 8 out of the distribution as shown in FIG. 5.

Figure 9:
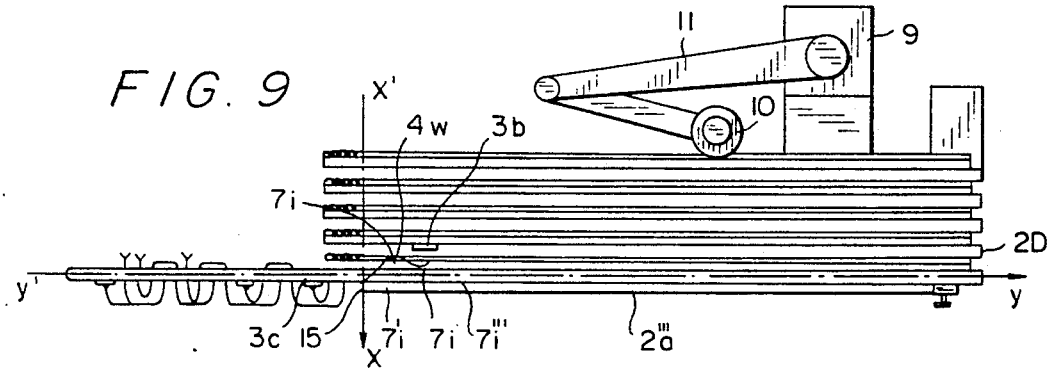

As shown in FIG. 9 and in the same way as above for the device in FIG. 2:

Clamp (3*b*) is transferred to conveyor (2D) using a carriage (15E) which is moved by conveyor (2"D);

Branch (7*i*) is bypassed by stop (4*w*). It is strung by moving clamp (3*b*) downstream using conveyor (2D);

Three links (7'*i*), (7"*i*), and (7'"*i*) are positioned by the manipulator endowed with linking clamp (9), (11), and (10).

Depending on the length of branch (7*i*), the computer orders guide rod (4*w*) to move downstream in order to allow clamp (3*b*) to be transferred to conveyor (2E).

Clamp (3*b*) is then returned on conveyor (2E) using carriage (15E) moved by conveyor (2"E). In this case and according to the sample embodiment in FIG. 4, jack (23) pulls clamp (3*b*) using device (23*a*).

Figure 8:
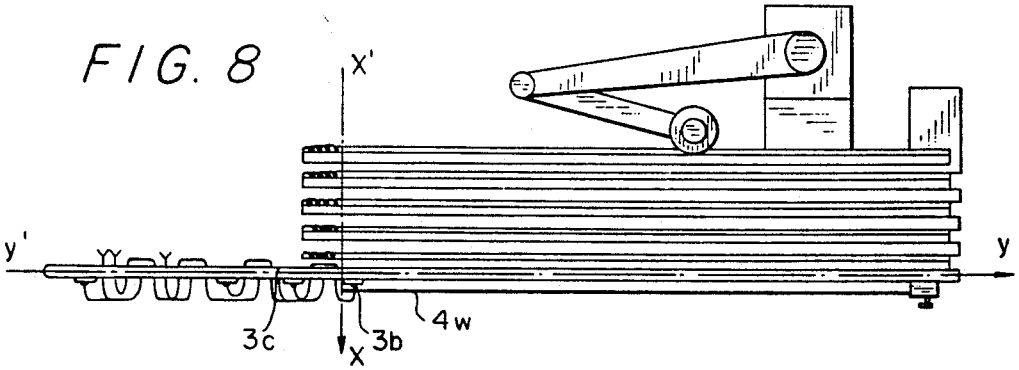
FIGS. 8 to 14 are partial and schematic plane and top views of different stages of the formation of branches of the wire bundles according to the second embodiment of the invention.

If necessary, guide rod (4*w*) can be returned to the position shown in FIG. 8. The arrangement of the overall bundle and the different clamps is then as shown in said FIG. 8 with three links (7'*i*), (7"*i*), (7'"*i*), which interconnect the wires of branch (7*i*).

According to the second phase of the example for forming the bundle shown in FIG. 1, conveyors (1) and (2E) are driven synchronously in order to transfer the set of clamps and to make the geometric configuration shown in FIG. 8 out of the one shown in FIG. 8. Three links (7'*j*), (7"*j*), (7'"*j*) are installed.

Branch (7*b*) is strung, then endowed with three links (7'*b*), (7"*b*), (7'"*b*), like branch (7*i*).

Figure 11:
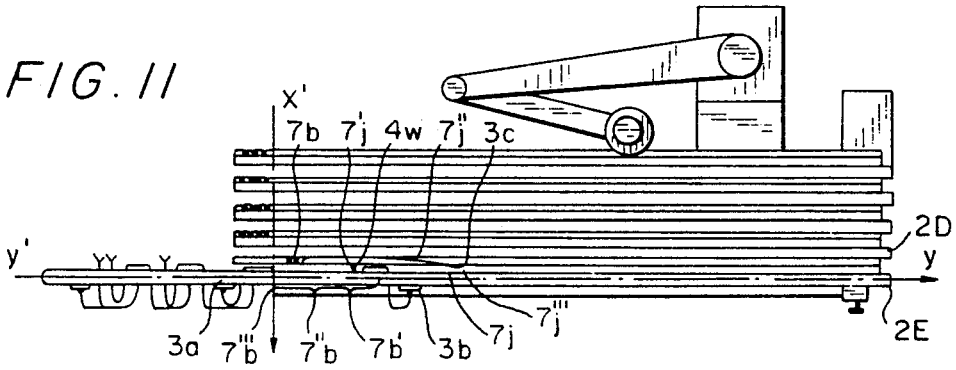

Conveyors (2F) and (2D) are then driven synchronously in order to transfer the set of clamps they carry, and to produce the configuration shown in FIG. 11.

Figure 10:
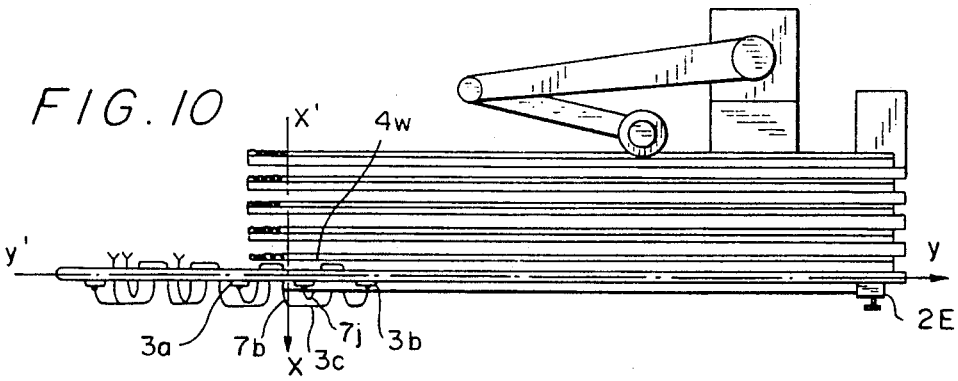

As above, clamp (3*c*) is taken back on conveyor (2F), conveyors (2E) and (2D) are transferred upstream, and, if necessary, guide rod (4*w*) is returned to the position shown in FIG. 10. The arrangement of the overall bundle and the different clamps is then as shown in FIG. 10 with three links (7'*b*), (7''*b*), (7'''*b*), which fasten the wires of branch (7*b*) together and with three links (7'*j*), (7''*j*), (7'''*j*) which interconnect the wires of branch (7*j*).

Figure 12:
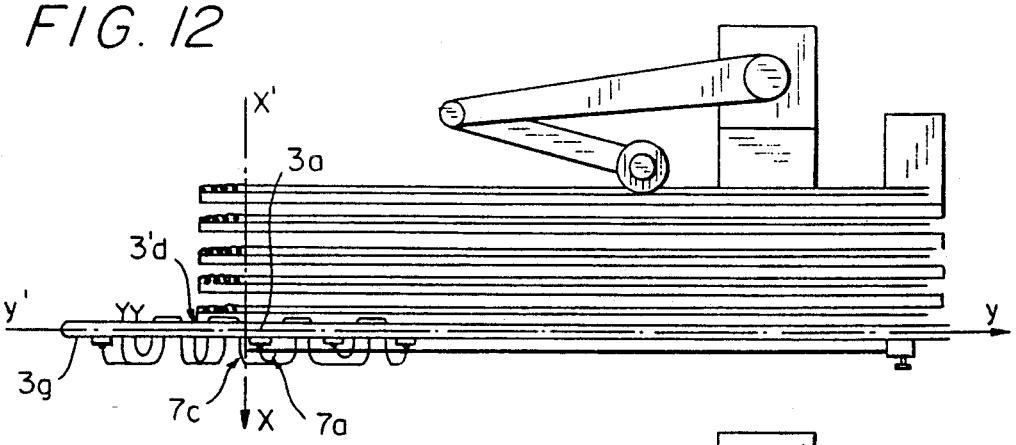

According to the third phase in the example for forming the bundle shown in FIG. 1, conveyors (1) and (2E) are driven synchronously to transfer the set of clamps and to make the geometric distribution in FIG. 10 into the distribution in FIG. 12. Tension is applied to branches (7*a*) and (7*c*) and the links are installed on said branches as above.

Figure 13:
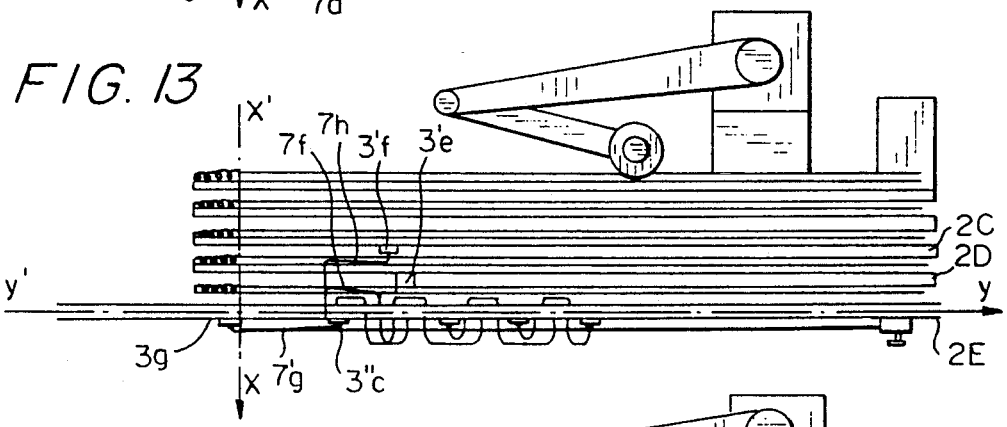

FIG. 13 shows a method of stringing and linking branches (7*g*), (7*f*), and (7*h*) through the use of three conveyors (2E), (2D), and (2C) as above.

Figure 14:
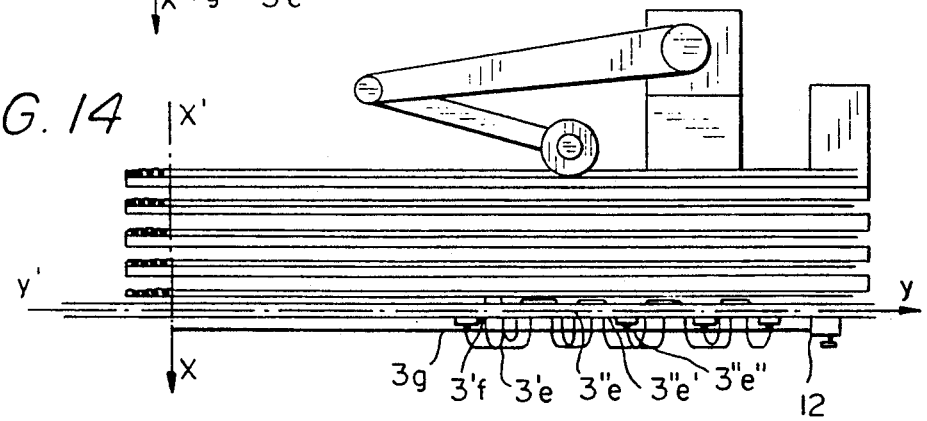

FIG. 14 shows the finished bundle delivered to the operator, who must disengage the connectors from clamps (3) and the branches from clamps (3'), and (3''). The computer, which had suspended the operation of the set of conveyors (2), orders that the empty clamps be removed as soon as the operator presses on button (12) to indicate that he has completed the bundle unloading operation.

According to the above-described process, different branches are strung one after the other, and in the order in which the different clamps are arranged on the conveyor.

Figure 15:
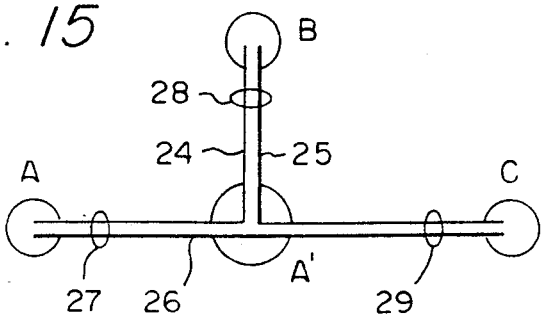
FIG. 15 shows an elementary bundle of three wires of the type being produced by the device shown in FIG. 7.

FIG. 15 shows an elementary bundle of three wires: (24), (25), (26). Said bundle comprises three ends: (A), (B), (C) and a bypass or node (A'), and is made of three branches (27), (28), and (29).

According to the example in FIG. 15, branch (27) comprises, between end zone (A) and bypass zone (A'), a part of wire sections (26) and (24). The end of the wire (26) of end zone (A) is labelled (24A).

FIG. 7 shows a device according to the invention in the process of making bundles of the type shown in FIG. 15.

Downstream from said device, we note two of these bundles. Their ends (A), (B), and (C) as well as the intermediary points associated with bypass (A') are held in clamps.

Conveyor (1') is only shown partially. The sequence of clamps (3''*a*), (3''*b*) to (3''*m*) continue until (3''*t*) in the part of said conveyor which is not shown. This part which is not shown also comprises empty clamps (3''*a*'), (3''*b*'), and (3''*c*') which are followed by clamps (3''*d*) to (3''*t*'). It can also comprise several sequences of clamps such as (3''*a*) to (3''*t*). The sequence of clamps (3''*a*') to (3''*t*') which is farthest upstream is the same type of sequence being positioned in clamps.

FIG. 7 is truncated in the downstream direction and comprises two references, I and II. The part which is not shown can be one of the devices partially shown in FIGS. 5 and 6, which also comprise references I and II. In this case, link installation unit (55) is optional because the links are installed by these devices.

According a special and advantageous embodiment, the branches are fastened near the bypass clamps by the link installation unit (55) placed along the clamp transfer path. The downstream part (not shown) in this case is limited to the mechanism to recycle the clamps defined in Patent Application FR 90 13137 (Claude Ricard) filed on Oct. 17, 1990, and to the bundle unloading mechanisms shown in FIG. 11. These mechanisms defined in other respects in the present patent advantageously comprise an electrical button (12), as in the device in FIG. 2, which allows the operator to indicate that he has removed the bundle. The computer, which had suspended the operation of conveyor (1''), is connected to this button. It orders that the empty clamps be removed as soon as it receives the signal emitted when the operator presses said button (12).

The loading unit shown in FIG. 7 is of the known type which makes it possible to position ends (A), (B), (C) of wire sections (24), (25), (26) in end clamps (3''). However, according to the invention, this device is endowed with complementary mechanisms used to grasp and hold the wire section in the bypass clamps and at other intermediary points of the ends which are associated with bundle bypasses.

Said end clamps and said bypass clamps are advantageously identical.

Said loading unit (30) is a part of a device for the automatic production of conductor wire or optical fiber bundles which is shown only partially and schematically in FIG. 7. Said device comprises a conveyor (1') made according to a known method, endowed with clamps (3'') which grasp and transport the wire section ends. The different clamps are distinguished by an index, for example (3''*a*) and (3''*a*').

Said loading unit positions wire section ends in said clamps transferred by said conveyor, and it comprises means which also position intermediary points of said section in some of said clamps.

According to the nonrestrictive sample embodiment in FIG. 7, wire (31) is taken between rollers (33) which are driven in rotation by motors (34) so as to unwind spool (32) and to inject it into telescopic tube (35).

The telescopic tube can be retracted to position (35*a*) to allow scissors (37) to cut the wire flush with the tube or to allow gripping clamp (38) to grasp it.

Wire (31) can be positioned in double fork (36) by moving said tube forward, then by moving the wire into position (35*b*). They move through double fork-shaped guide (36) and the wire remains in this fork when the tube is retracted.

According to the example in FIG. 7, the loading unit also comprises a gripping clamp (38) shown in detail in FIGS. 16 and 17. The loading unit shown in FIG. 7 is moved by mechanisms comprising:

A rotating jack (41) which makes it possible to deliver gripping clamp (38) moved rotationally by motor (39) above:

Either bypass clamp (3''*t*) to engage a wire therein, the gripping clamp in this case being as shown as (38) and the motor, in (39);

Or double fork (36) to take the wire therefrom; gripping clamp in this case being as (38*a*) and the motor, (39);

An indexed motor (39) which makes it possible to rotate gripping clamp (38) and to deliver it, as shown, over bypass clamp (3''*t*) and over double fork (36). The rotation takes place in the clockwise or the counterclockwise direction around the axis of vertical shaft (40), parallel to the Z'Z axis. Under the effects of said first two mechanisms, the final result of the movements of gripping clamp (38) from double fork (36) to the clamp is either a simple translation or said translation associated with a 180 rotation of said clamp around axis (40').

A jack (40) which enables the following to occur during vertical displacements parallel to the Z'Z axis:

Either in taking position (38*a*): to take part of the wire by moving gripping clamp (38) downward, jaws open, between the teeth of double fork (36), closing said jaws on the wire guided in said double fork and moving said gripping clamp holding said part of the wire back upward;

Or in transfer position (38): to transfer said part of the wire held in said bypass clamp (3''*t*) by moving clamp (38) placed over clamp (3''*t*) downward, which engages the wire between the arms of said end clamp, then by moving it back upward, jaws open.

As a non-restrictive example, the device in FIG. 7 positions wire (24) by performing the following sequence of actions ordered in succession by computer (42):

Initially, the device is in the following state:

Tube (35) is retracted in position (35*a*);

The wire is cut flush with end (35*a*);

Gripping clamp (38) is placed in loading position perpendicular to double fork (36) with its jaws aligned in order to grasp along the X'X axis.

Production of a new bundle begins with the positioning of nine empty bypass clamps (3''*a*'), (3''*b*'), . . . , (3''*i*') on conveyor (1');

Positioning of downstream end (26''C) begins. An end clamp (3''*j*') is placed on conveyor (1') which is moved one step forward and which delivers it in loading position;

The tube is brought out to position (35*b*). Motors (34) are ordered to unwind the wire to said position (35*b*). The tube is then retracted to position (35*a*). It exposes the end of the wire which is now guided in double fork (36).

The gripping clamp is moved downward, jaws open, between the teeth of fork (36). The jaws are closed on the wire. The gripping clamp is moved back up with the wire.

Gripping clamp (38) is moved to transfer position over end clamp (3''*j*') in a translation movement coupled with a 180° rotation. The end which was directed along the X'X axis at the outlet of tube (35) is thus returned and held along the XX' axis. Gripping clamp (38) transfers said end directed along the XX' axis into end clamp (3''*j*). During all of these movements of the gripping clamp, the wire is delivered by motors (34) as needed for movements.

Gripping clamp (38) is returned empty to taking position.

The new bypass clamp (3''*k*') is placed on conveyor (1') which is advanced one step.

The wire is unwound by motors (35) until it places said first predetermined intermediary point of said section to be positioned in bypass clamp (3''*k*') in double fork (36).

Gripping clamp (38) moves downward in open position, grasps the wire, and moves back upward. It is moved to transfer position, while motors (34) simultaneously deliver the wire necessary for this movement. This movement is generally a translation movement: the end of the wire which was directed along the X'X axis at the outlet of tube (35) is still held along the X'X axis. Gripping clamp (38) transfers this end directed along the X'X axis into bypass clamp (3''*k*').

Gripping clamp (38) returns empty to taking position.

The positioning of the first intermediary point of wire (26') corresponding to bypass (A') ends, and the positioning of the second intermediary point of wire (26') corresponding to bypass (A') begins.

The wire is unwound by motors (35) until the second predetermined intermediary point of said section to be positioned in bypass clamp (3''1') is placed in double fork (36).

Gripping clamp (38) moves downward in open position, grasps the wire, moves back upward and displaces toward the transfer position, while motors (34) simultaneously deliver the wire needed for this movement. This movement is generally a translation movement coupled with a 180 rotation: the end of the wire which was directed along the X'X axis at the outlet of tube (35) is thus returned and held along the XX' axis.

The new bypass clamp (3''1') is placed on conveyor (1') which is advanced one step.

Gripping clamp (3B) transfers said end directed along the XX' axis into bypass clamp (3''1').

Gripping clamp (38) returns empty to taking position.

The positioning of the second intermediary point of wire (26') corresponding to bypass (A') ends and the positioning of upstream end (26''A) begins.

The new clamp (3''*m*') is placed on conveyor (1') which is advanced one step.

The wire is unwound by motors (35) until the second end of wire section (26') is placed in the axis of scissors (37).

Gripping clamp (38) moves downward in open position, grasps the wire and holds it.

Scissors (37) cut the wire at level (35*a*).

Gripping clamp (38) moves back upward and displaces to transfer position. This movement is generally a translation movement; the end which was directed along the X'X axis at the outlet of tube (35) is held along the X'X axis.

Gripping clamp (38) transfers this end directed along the X'X axis into end clamp (3''*u*).

Gripping clamp (38) returns empty to taking position.

The positioning of the upstream end (26''C) of wire (26') is completed.

Downstream end (25''A) of intermediary points (25''A') and downstream end (25''C) of wire (25') are positioned in the same way as wire (26') described in detail above.

Downstream end (24''B) of intermediary points (24''A') and upstream end (24''A) of wire (24') are positioned in the same way.

The positioning of the ends in end clamps and the predetermined intermediary points in bypass clamps is completed.

The production of a new bundle is resumed with the positioning on the conveyor of nine empty bypass clamps which will advantageously be the same type as the preceding ones.

Advantageously and a described above and shown in FIG. 7, an intermediary point of a wire associated with a bypass is held at two points using two bypass clamps: clamps (3''*k*) and (3''1) for wire (26).

The device, shown in FIG. 7, thus advantageously comprises mechanisms to unwind wire sections of predetermined lengths as well as control mechanisms which order the wire to be unwound, and which stop the wire at predetermined intermediary points corresponding to bypasses. In the nonrestrictive case in this example, said control mechanisms are advantageously included in the form of software in computer (42). Another advantageous solution consists of placing a programmable robot or a secondary computer (42') on the loading unit and connecting it by a link to main computer (42). Said robot specifically controls said unit and orders the overall actions, whose definitions it receives through said link, to be performed.

FIG. 7 shows end clamps such as (3''j') and (3''m'), holding ends such as (26'C) and (26'A). It also shows bypass clamps such as (3''k') and (3''1'), holding intermediary points associated with bypasses such as (26'A'). Said figure shows that wire sections are grasped and held in bypass clamps at other intermediary points of the ends which are associated with bundle bypasses.

According to FIG. 7, said clamps are transferred by conveyor (1') to grouping unit (43) which makes it possible to group several of said intermediary points which are associated with the same bypass into the same bypass clamp.

According to the sample embodiment in FIG. 7, conveyor (1') has transferred clamps (3''k) and (3''j) and nine empty clamps (3''a) to (3''i) into the field of action of transfer unit (43).

The transfer unit is advantageously placed astride two independently-motorized conveyors. According to the example in FIG. 7, synchronous belt (1') conveyor ends between clamps (3''j) and (3''i). It drives the clamps to clamp (3''). It is followed by conveyor (1') which drives the clamps beginning with clamp (3''i).

Two corresponding clamp opening systems are placed in front of the clamps located in the last two positions of conveyor (1'), clamps (3''k) and (3''j) in FIG. 7. Such a system, which is shown in FIG. 16 according to reference (56), is known.

The transfer unit is advantageously endowed with gripping mechanisms which can simultaneously grasp two intermediary points, and the field of action of said transfer unit (43) encompasses at least two clamps on upstream conveyor (1') in order to transfer the two intermediary points of a wire associated with the same bypass simultaneously to two bypass clamps held by downstream conveyor (1').

FIG. 7 shows a sample embodiment of said transfer unit (43). A manipulator is endowed with two gripping clamps (44) and (44'), of the same type as gripping clamp (38). Said manipulator is also endowed with mechanisms making it possible to move them from one point to another on said conveyor.

A first part of said displacement mechanism consists of two jacks (45), (45') similar to jack (41) which make it possible to lower gripping mechanism (44), (44') independently to the level of clamps (3''a) to (3''j).

The second part of said mechanisms is of the fastening lug type. Motor (46) drives endless screw (47) in rotation, said endless screw cooperating with the nut attached to mobile unit (48). Said nut drives said unit (48) in translation, guided by slides (49) along the conveyor so that the gripping components move perpendicularly to clamps (3''a) to (3''j).

To enable said first manipulator (44) to grasp the end held by clamp (3''j) which is then opened by opening mechanisms associated therewith, to disengage said end from said clamp, which is closed again after it has been emptied, to move and engage said end in another predetermined clamp (3''a) to (3''i) [sic]. Clamp (3''j) is then ejected to the return conveyor according to an embodiment recommended in Patent FR 90 13137 (Claude Ricard). Mechanisms (19) for ejecting the empty clamps from conveyor (1') to the return conveyor are located at the level of clamps (3''k) and (3''j) as shown in FIG. 7.

Said gripping components comprise clamps (38') and (38'') made according to the example in FIGS. 16 and 17. To engage the wire, clamp (38') forces the arms (50) of clamp (3''j) to open.

According to FIG. 17, the arms are moved apart by the action of said wire which acts as a wedge on part (50a) of said arms. The "V" shape facilitates the opening of said arms pivoting around axes (52b) and held closed by springs (51).

According to the embodiment in FIGS. 16 and 17, the gripping clamp advantageously comprises a push finger (53) which can become engaged between the arms of the clamp and which supports the wire when it becomes engaged in a clamp and which holds it temporarily during the retraction phase.

According to this figure, the wire is held by gripping clamp (38') made according to the example in FIGS. 16–9. When the wire is inserted into a clamp, said wire is held, among other things, by finger (53) which supports the wire which repels piston (52). At the end of the downward course, the lower part of finger (53) is at the same level as the internal form detail (50b) of the arms.

Advantageously, said finger comprises a form detail (69) in its lower part in contact with the wire in order to hold the wire, and whose profile is V-shaped or concave.

If the clamp is made by interlocking arms or if the clamp comprises form details which impede the use of a finger as shown, said finger will advantageously be cut out in order to slide between said arms or to avoid said form details.

In this way, the wire or different wires present in the clamp are held temporarily and especially when the arms are forced to open by the wire positioned by compression between piston (52) pushed toward the finger by spring (54) and finger (53). Said wires are also compressed and held by shearing between the edges of piston (52) and the edges of fingers (50) closed by springs (51).

Even if the gripping clamp engages a wire in an empty clamp at this stage of action of the device, we note that the positioning action is performed in the same way no matter how many wires have already been taken in the clamp.

The cavity composed of profile (50b) of the arms and profile (52a) of the piston is adapted to the volume of the wire it holds compressed. Moreover, as when a wire is inserted, the wire itself forces the arms to open; the arms open only enough to allow it to pass, and the wires it already holds cannot escape.

According to the example shown in FIG. 7, after having ordered the downstream end of wire (26) to be taken, end (26C) in clamp (3''j), the computer moves mobile unit (48) to bring component (44) in perpendicular position to clamp (3''a). It engages said end in said empty clamp of said conveyor by moving the gripping mechanism to the lower position as described above.

The computer also orders:

The simultaneous transfer of intermediary points (26A') of wire (26) held by clamps (3''k) and (3''1) to clamps (3''c) and (3''d) arranged in the field of unit (43);

The transfer of end (26A) held by clamp (3''m) into clamp (3''h);

The transfer of downstream end (25C) of wire (25) held by clamp (3''n) to clamp (3''b);

The simultaneous transfer of intermediary points (25A') of wire (25) held by clamps (3''o) and (3''p) to clamps (3''c) and (3''e).

The transfer of upstream end (25B) of wire (25) held by clamp (3''q) to clamp (3''f);

The transfer of downstream end (24B) of wire (24) held by clamp (3''r) to clamp (3''g).

The simultaneous transfer of intermediary points (24A') of wire (24) held by clamps (3''s) and (3''t) to clamps (3''e) and (3''d);

The transfer of upstream end (24A) to clamp (3''i).

Advantageously, as described above and shown in FIG. 7, the wires of the branches of a bypass are arranged and held separately, branch by branch, in several contiguously-arranged bypass clamps (3'').

FIG. 7 also shows a particular embodiment of the invention wherein the branches are attached near the bypass clamps by link installation unit (55).

According to FIG. 7, said link installation unit is located downstream from transfer unit (43). It is composed of a jack (56), controlled by computer (42), which lowers the linking clamp of the known type (10) so that its arms (10a) grasp the set of wires of a branch held in the bypass clamp which conveyor (1'') delivers to it. The computer then orders the linking clamp to fasten together the set of wires of said branch, to open arms (10a), and to return the linking clamp to the position above said bypass clamp.

According to the embodiment shown in FIG. 7 and described above:

A first conveyor endowed with end clamps to grasp and hold said ends is transferred by intermittence.

Said ends are grasped, held, and transferred by intermittence along a specific transfer path using said end clamps of said first conveyor.

Said end clamps are used to deliver some of said ends to end processing units arranged laterally along said transfer path.

Said ends are modified using said end processing units.

Said ends are delivered to a coupling unit which groups several ends together in the same end clamp.

Said ends are delivered to an interchange unit which changes the order of some of said ends on said first conveyor.

Several of said ends are delivered to a connection unit which connects some of said ends to components attached to a component clamp.

Said component clamp is positioned on said first conveyor when all of the ends are connected.

Several of said intermediary points associated with the same bypass are grouped together in the same bypass clamp.

Said bypass clamp are moved apart with said different clamps in order to form the bundle.

I claim:

1. A process for the automatic production of conductor wire or optical bundles having a plurality of branches, comprising the steps of:

separately engaging wire ends of a plurality of wire sections of each of said plurality of branches in preselected clamps on a supply conveyor, moving said clamps on said supply conveyor to grid means for spacing said clamps apart in a predetermined geographic position on said grid, spacing said clamps in said geographic position on said grid, fastening said wire sections engaged in said clamps together, and removing said clamps to form said bundles.

2. The process according to claim 1, wherein, branches of said plurality of branches forming the greatest number of continuous branches are strung along one of a set of conveyors forming said grid in a direction of a longitudinal axis of said one of a set of conveyors.

3. The process according to claim 1, further including the steps of:

intermittently transforming said clamps along said supply conveyor, delivering some of said wire ends in said clamps to end processing units located laterally along a path of said supply conveyor, modifying said some of said wire ends in said end processing units, delivering said wire ends to a coupling unit which groups several of said wire ends in one of said clamps, delivering said wire ends on said supply conveyor to an exchange unit which changes an order of some of said wire ends, delivering said wire ends on said supply conveyor to a connection unit which connects some of said wire ends to connectors engaged on a component clamp, engaging said component clamp on said supply conveyor when said connector has been engaged to said some of said wire ends;

engaging said wire sections at intermediary points of said wire ends defining a start of branches of said plurality of branches in bypass clamps, wherein a plurality of said intermediary points associated with one of said branches of said plurality of branches are grouped in one of said bypass clamps.

4. The process according to claim 1 wherein, said wire sections are grasped and held in said bypass clamps at other intermediary points of said wire ends, which are associated with bundle branches, several of said intermediary points associated with the same branch are grouped in one of said bypass clamps, said clamps are used to move said bypass clamps apart to form the bundle.

5. The process according to claim 1, wherein several of said plurality of branches are strung one after the other.

6. The process according to claim 1, wherein the clamps are moved apart using one or more second conveyors of the same type as said first conveyor.

7. The process for the automatic production of conductor wire or optical fiber bundles having a plurality of branches with ends of wire sections and connectors for connecting ends of wire sections are transported in different clamps wherein, a supply conveyor endowed at least with component clamps (3) transports connectors (24) to which some of said ends are connected, moving said component clamps apart on a grid means for spacing said component clamps apart in a predetermined geographic position on said grid and to string the bundle branches, joining together said wire sections of one of said plurality of branches.

8. The process according to claim 7, wherein said grid means to move said clamps apart comprises at least one second conveyor of the same type as said supply conveyor.

9. The process according to claim 7, wherein said grid means for spacing said clips apart comprises multiple guide rods (4) which engage and arrange branches (7) of said bundle.

10. The process according to claim 7, wherein said supply conveyor is associated with wire feed means for unwinding wire sections of predetermined lengths including control mechanisms which order the wire to be unwound and which stop the wire at predetermined intermediary points defining a start of said branches.

11. Process for the automatic production of conductor wire or optical fiber bundles which comprise several branches and bypasses, of the type in which wire section ends and components are transported in different clamps wherein, wire sections are grasped and held in bypass clamps at other intermediary points of the ends, which are associated with bundle bypasses, several of said intermediary points, which are associated with one of said bypasses, are grouped in one of said bypass clamps.

12. Process according to claim 11, wherein some of said clamps are also moved apart to form the bundle into several branches.

13. Process according to claim 11, wherein the wires of the branches of a bypass are held separately, branch by branch, in several contiguously-placed bypass clamps (3").

14. Process according to claim 11, wherein an intermediary point associated with a bypass is held at two points.

15. Process according to claim 11, wherein the branches are attached near the bypass clamps.

* * * * *